US007763853B2

(12) United States Patent
Walsh

(10) Patent No.: US 7,763,853 B2
(45) Date of Patent: Jul. 27, 2010

(54) DICOROTRON HAVING ADJUSTABLE WIRE HEIGHT

(75) Inventor: James D Walsh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 195 days.

(21) Appl. No.: 11/751,876

(22) Filed: May 22, 2007

(65) Prior Publication Data

US 2008/0290276 A1 Nov. 27, 2008

(51) Int. Cl.
*H01T 19/04* (2006.01)
*G03G 15/02* (2006.01)
*G03G 15/00* (2006.01)

(52) U.S. Cl. ..... 250/326; 250/324; 399/50; 399/89; 361/229

(58) Field of Classification Search ..... 250/324, 250/325, 326; 399/50, 89, 46, 311
See application file for complete search history.

(56) References Cited

U.S. PATENT DOCUMENTS 3,909,614 A * 9/1975 Marshall ..... 250/324
3,922,548 A * 11/1975 Honda ..... 250/324
4,089,600 A * 5/1978 Ito et al. ..... 250/324
4,203,144 A * 5/1980 Okamoto ..... 250/324
4,320,957 A * 3/1982 Brown et al. ..... 250/324
4,456,825 A * 6/1984 Kuge et al. ..... 250/324
4,872,083 A * 10/1989 Blitshteyn ..... 250/324
5,339,137 A * 8/1994 Kusumoto et al. ..... 399/50
5,809,364 A * 9/1998 Tombs et al. ..... 399/9
5,839,024 A * 11/1998 May et al. ..... 399/89
6,928,250 B1 8/2005 Adams et al.
2005/0111890 A1* 5/2005 Hasenauer et al. ..... 399/315

* cited by examiner

*Primary Examiner*—Jack I Berman
*Assistant Examiner*—Brooke Purinton
(74) *Attorney, Agent, or Firm*—Lloyd F. Bean, II

(57) ABSTRACT

A corona generating device for charging a surface including, a housing; the housing including spaced generally parallel side panels; members for holding a corona generating electrode in an operable position within the housing; and system for adjusting the height spacing of the corona generating electrode relative to the surface the adjusting system includes a first bridge member adjacent to the inboard wire mount and a second bridge member adjacent to the outboard wire mount, the first bridge member and second bridge member contacts the wire to change the distance of the wire relative to the surface.

7 Claims, 5 Drawing Sheets

DICOROTRON HAVING ADJUSTABLE WIRE HEIGHT

This invention relates generally to a corona generating device, and more particularly concerns a dicorotron having adjustable wire height.

In a typical electrophotographic printing process, a photoconductive member is charged to a substantially uniform potential so as to sensitize the surface thereof. The charged portion of the photoconductive member is exposed to a light image of an original document being reproduced.

Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet.

The toner particles are heated to permanently affix the powder image to the copy sheet.

In printing machines such as those described above, corona devices perform a variety of other functions in the printing process. For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions.

One form of a corona charging device comprises a corona electrode in the form of an elongated wire connected by way of an insulated cable to a high voltage AC/DC power supply. The corona wire is partially surrounded by a conductive shield. The photoconductive member is spaced from the corona wire on the side opposite the shield. An AC voltage may be applied to the corona wire and at the same time, a DC bias voltage is applied to the shield to regulate ion flow from the corona wire to the photoconductive member being charged.

Another form of a corona charging device is pin corotrons and scorotrons. The pin corotron comprises an array of pins integrally formed from a sheet metal member that is connected by a high voltage cable to a high power supply. The sheet metal member is supported between insulated end blocks and mounted within a conductive shield. The photoconductive member to be charged is spaced from the sheet metal member on the opposite side of the shield. The scorotron is similar to the pin corotron, but is additionally provided with a screen or control grid disposed between the coronode and the photoconductive member. The screen is held at a lower potential approximating the charge level to be placed on the photoconductive member. The scorotron provides for more uniform charging and prevents overcharging.

Still other forms of corona charging devices include a dicorotron. The dicorotron comprises a coronode having a conductive wire that is coated with an electrically insulating material. When AC power is applied to the coronode by way of an insulated cable, substantially no net DC current flows in the wire due to the thickness of the insulating material. Thus, when the conductive shield forming a part of dicorotron and the photoconductive member passing thereunder at the same potential, no current flows to the photoconductive member or the conductive shield. However, when the shield and photoconductive member are at different potentials, for example, when there is a copy sheet attached to the photoconductive member to which toner images have been electrostatically transferred thereto, an electrostatic field is established between the shield and the photoconductive member which causes current to flow from the shield to the ground.

In a high speed color machine capable of producing 100 or more images per minute, such as the IGEN3® manufactured by Xerox, requires a charging device capable of delivering uniform charging performance during high speed imaging. Delivering uniform charging performance is more acute with dicorotron used in precleaning, e.g.: during operation it often occurs that the power supply is unable to always deliver enough energy to the dicorotron to generate the needed charge for cleaning. The result is a logged fault stating the power supply has reached it's maximum value. With out the delivery of the full desired preclean charge the clean system is less effective and could result in potential customer dissatisfaction The ability to change the power supply to meet the desired energy level is costly and time consuming. Also redesigning the system to move the full dicorotron closer to the needed surface generates design issues that can not be resolved and would not be field implementable.

The present invention obviates the problems noted above by providing a corona generating device for charging a surface including: a housing; said housing including spaced generally parallel side panels; means for holding a corona generating electrode in an operable position within said housing; and means for adjusting the height spacing of said corona generating electrode relative to said surface.

Other aspects of the present invention will become apparent as the following description proceeds and upon reference to the drawings, in which.

Figure 1:
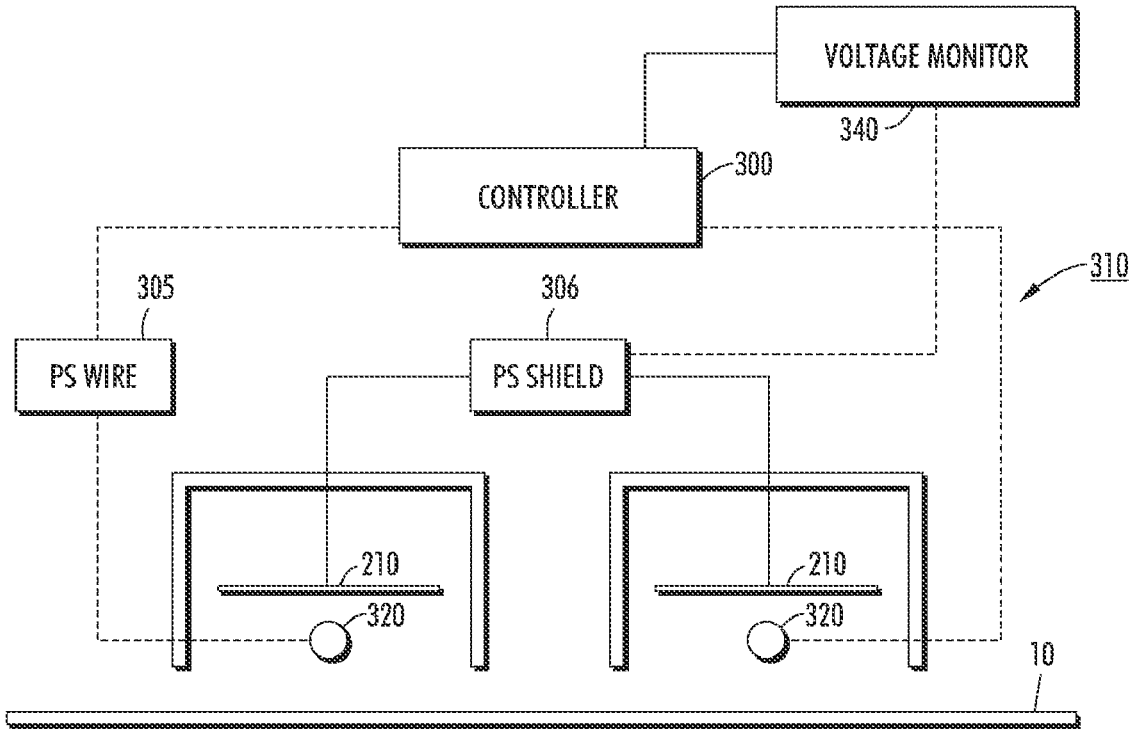
FIGS. 1-4 are illustrated configurations of a discorotron useful in the printer apparatus.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 5:
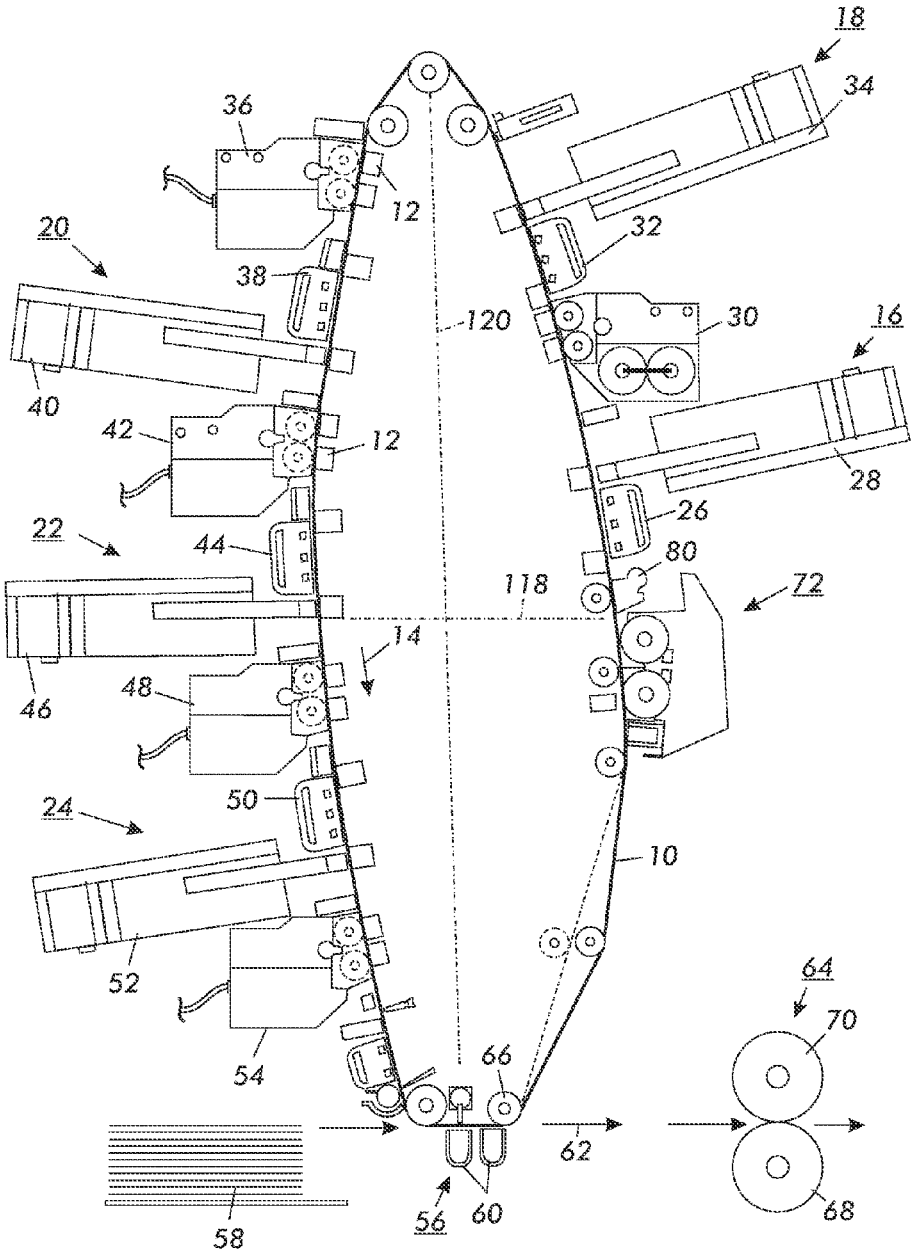
FIG. 5 is a schematic elevational view depicting an illustrative high speed color electrophotographic printing machine incorporating the apparatus of the present invention therein.

Referring initially to FIG. 5, there is shown a high speed color electrophotographic printing machine, capable of producing over 100 images per minute, such as Xerox's IGEN3S, having the charging device of the present invention therein. Referring now to the drawing, there is shown a single pass multi-color printing machine. This printing machine employs a photoconductive belt 10, supported by a plurality of rollers or bars. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt has a major axis 120 and a minor axis 118. The major and minor axes are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller which isolates the cleaning operation at cleaning station 72. At cleaning station 72, the residual toner particles are removed from photoconductive belt 10. Photoconductive belt 10 then moves under spots blade 80 to also remove toner particles therefrom.

Turning now to FIGS. 1-5 inclusive, there are illustrated configurations of dicorotrons useful in the printer apparatus of FIG. 5. Charging devices 26, 32, 38, 44 and 50 utilize dicorotrons similar to dicorotron 170. Preferably, charging devices are operated by a controller employing a closed loop feedback such as disclosed in U.S. Pat. No. 6,928,250 entitled "Closed loop control function for corona device", which is hereby incorporated by reference.

Referring to FIG. 1, the charging system includes a power supply controller 300 to actuate and monitor two power supplies 305 and 306 which in turn respectively drive and control the shield current, and wire voltage for dicorotrons. Controller 300 may be either software or hardware derived. Controller 300 employs digital values corresponding to the power supply actuation levels. The digital values arrived at are converted by a digital to analog (D/A) converter for use in controlling the output of the power supplies. Target values for use in setting and adjusting the operation of the power supplies are provided by a system controller in accordance with system operational requirements.

In operation, the high voltage power supply controller periodically polls the shield voltage monitors. If these monitor signals meet the criteria established (too high or too low) the high voltage power supply controller would then adjust the wire voltage analog control. This is an iterative process. The next polling of the shield voltage monitors is used to further refine the wire voltage setting, etc. The various analog monitors and controls are made available to the system controller. It is at the system controller level that the monitors and controls can be evaluated and inferences drawn to device health, media condition or environmental conditions.

Preferably charging device employed in the present invention is a dicorotrons 170. The dicorotrons produce a voltage potential on the media substrate to transfer the developed latent image onto the media substrate. The dicorotron includes a coronode member which is preferably a wire 320 and shield 210. Power supply provides a current source for supplying a constant current to shield. Voltage monitor 340 measures the voltage on the shield 210. The voltage monitor periodically polls the voltage during a cycle of a print job and generates a voltage measured signal as a function thereof.

Figure 2:
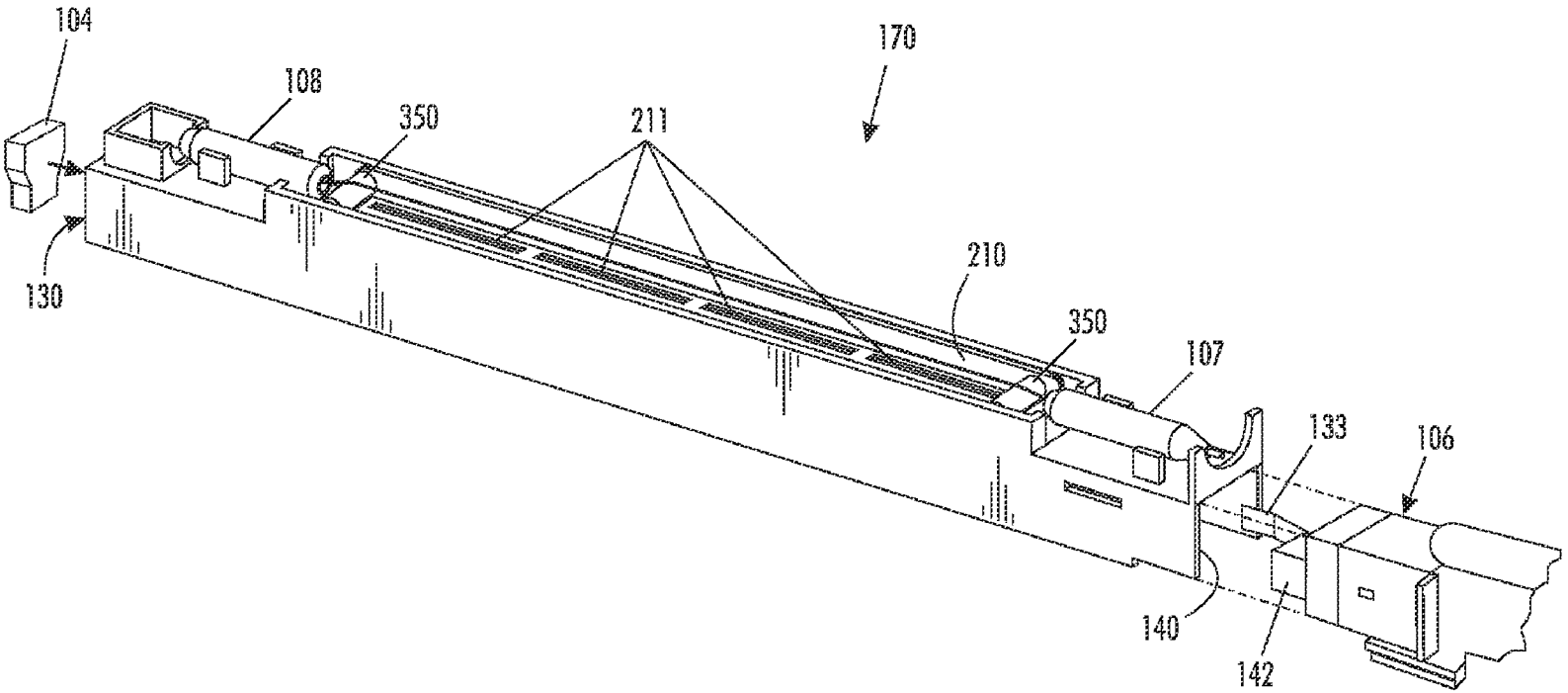

Referring to FIG. 2, Dicorotron 170 includes housing having a generally U-shaped cross-sectional configuration having parallel side panels defining a cavity therebetween that is composed of an insulated material such as plastic. Shield insert 210 is positioned on the bottom of housing and is powered by power supply (not shown). A dielectric coated coronode wire located at a predetermined distance from the shield. The preferred coating on the wire is a glass coating. Shield insert has a generally U-shaped cross-sectional configuration which includes a pair of spaced sides with a lower portion therebetween. Shield is insertable and removable from the cavity form by the U-shaped cross-sectional configuration. In operation, the top surface of the lower portion of shield insert is a conductive shield and a bottom surface of the lower portion of the shield insert forms an evacuation chamber between the housing and the shield insert. Lower portion of shield insert includes evacuation slots 211 defined therein which allows airborne contaminants to move to the evacuation chamber when a vacuum is applied to evacuation chamber. End receptacle 106 is positioned at on end of housing, and provides an electrical biasing contact with shield insert in which contact 133 contacts tab portion of shield 210. End receptacle includes port 142, connected to evacuation chamber which removes airborne contaminants from evacuation chamber when a vacuum is applied to port. Members 107 and 108 hold the coronode wire at a predefined tension. End receptacle 106 also provides a contact point for biasing coronode wire. End block 104 enclosing end 130 of evacuation chamber and receptacle 106 encloses end 140 of an evacuation chamber.

Figure 3:
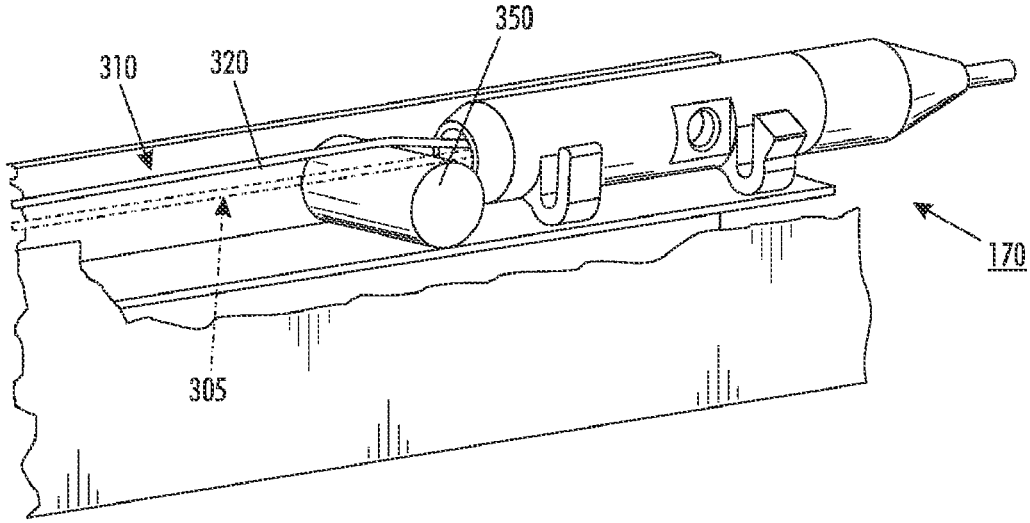

Applicants have found that the power supply is not always able to deliver enough energy to the dicorotron to generate the needed charge. The result is a logged fault stating the power supply has reached its maximum value. To overcome this problem, bridge members 350 and 352 are positioned near end receptacle 107 and end portion 108. Referring to FIG. 3 an enlarged view of one end, bridge member 350 in contact with coronode wire 320 and adjust the spacing of the coronode wire 320 from first position 305 to second positioned 310. Bridge members 350 and 352 are removable and can be replaced with bridge members of different predefined sizes, preferably bridge member are composed of a dielectric material. By adding these bridge features on each end reduces the wire to photoreceptor gap, the power required by the charging process is reduced, thus reducing the number of power supply faults being generated.

Figure 4:
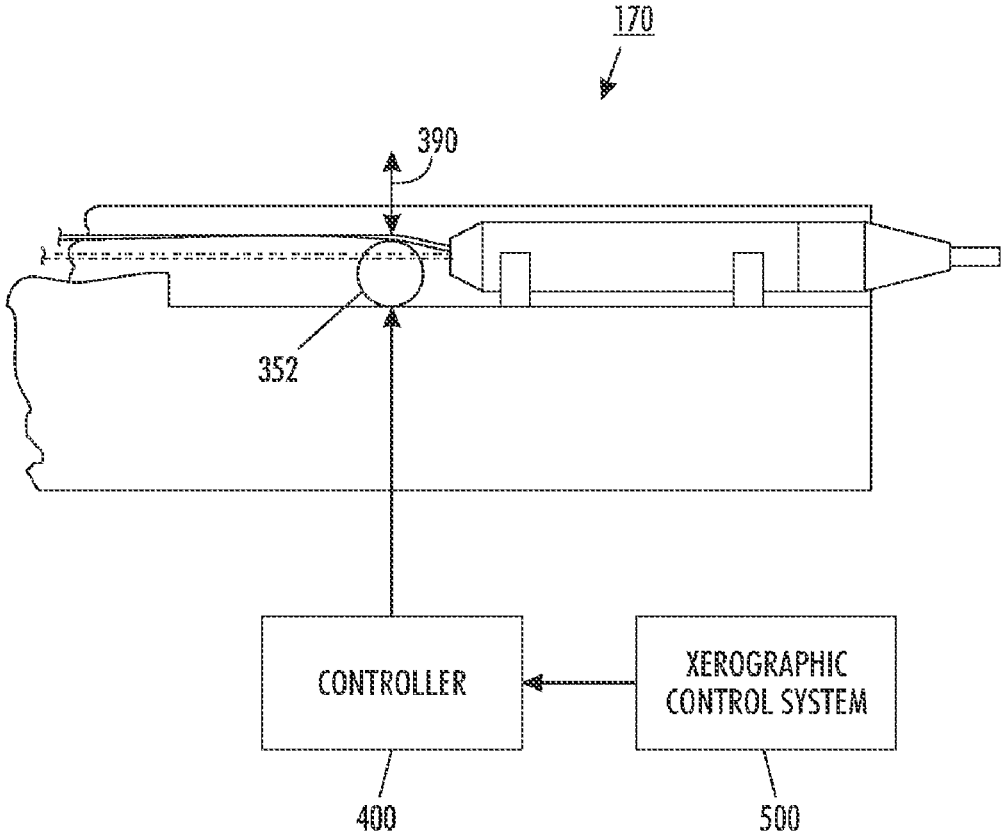

Referring to FIG. 4 there is shown a dicorotron with variable adjustable bridge members that fit under the coronode wire. Controller 400 controls the height adjustments of the variable adjustable bridge members as designate by double arrow 390. Controller 400 is in communication with power supply controller 300 can send a feedback signal to supply controller 300 whereupon controller 400 can adjusts the spacing of the coronode wire to maintain a desire charging level without a power supply fault. In addition, controller 400 can receive feedback signals from other sensors such as an ESV sensor and xerographic actuators such as transfer current or Mag Roll voltages and adjusts the spacing of the coronode wire in response thereto.

Typically the electrical charge generated by a dicor across the width of a photoreceptor is not balanced. This imbalance is typically adjusted out of the process by raising or lowering one end or the other of the dicor mounting assembly to change the dicor height inboard to outboard. An advantage feature of the present disclosure is that controller 400 can adjust the spacing of the coronode wire at each end of the wire independent of each other to correct any imbalance from inboard to outboard.

It is, therefore, apparent that there has been provided in accordance with the present invention, a charging apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A corona generating device for charging a surface comprising, a housing; said housing including spaced generally parallel side panels;

means for holding a corona generating electrode in an operable position within said housing;

means for adjusting the height spacing of said corona generating electrode relative to said surface;

a power supply for biasing said corona generating electrode, said power supply changes a voltage output thereof to maintain a predefined charging output of said corona generating electrode;

means for monitoring said voltage output of said power supply and said charging output of said corona generating electrode and generating a feedback signal of said voltage output and said charging output; and wherein said adjusting means adjusts the height spacing of said corona generating electrode from a first predefined height spacing to a second predefined height spacing to maintain said predefined charging output of said corona generating electrode, when said voltage output approaches a predefined threshold level.

2. A corona generating device of claim 1, wherein said corona generating electrode includes a wire.

3. A corona generating device of claim 2, wherein said holding means includes an inboard wire mount and an outboard wire mount, and said wire extends between said inboard wire mount and said outboard wire mount.

4. A corona generating device of claim 3, wherein said adjusting means includes a first bridge member adjacent to said inboard wire mount and a second bridge member adjacent to said outboard wire mount, said first bridge member and second bridge member contacts and adjust from said first predefined height spacing to said second predefined height spacing.

5. A corona generating device of claim 4, wherein said first bridge member and said second bridge member are of a predefined size.

6. A corona generating device of claim 4, wherein said first bridge member and said second bridge member have adjustable sizes.

7. A corona generating device of claim 1, wherein said adjusting means adjusts each end of said corona generating electrode independent of each other.

* * * * *